US006105503A

United States Patent [19]

Baginski

[11] Patent Number: 6,105,503

[45] Date of Patent: Aug. 22, 2000

[54] ELECTRO-EXPLOSIVE DEVICE WITH SHAPED PRIMARY CHARGE

[75] Inventor: Thomas A. Baginski, Auburn, Ala.

[73] Assignee: Auburn University, Auburn, Ala.

[21] Appl. No.: 09/039,809

[22] Filed: Mar. 16, 1998

[51] Int. Cl.[7] ..... F42B 3/18

[52] U.S. Cl. ..... 102/202.5; 102/202.2; 102/202.7; 102/202.9

[58] Field of Search ..... 102/202.1, 202.2, 102/202.5, 202.7, 202.9, 306–310, 472, 476

[56] References Cited

U.S. PATENT DOCUMENTS

| | | | |
|---|---|---|---|
| 2,821,139 | 1/1958 | Apstein et al. | 102/70.2 |
| 3,211,096 | 10/1965 | Forney et al. | 102/28 |
| 3,420,174 | 1/1969 | Potter | 102/28 |
| 3,572,247 | 3/1971 | Warshall | 102/28 |
| 3,640,224 | 2/1972 | Petrick et al. | 102/28 |
| 3,669,022 | 6/1972 | Dahn et al. | 102/28 |
| 3,682,096 | 8/1972 | Ludke et al. | 102/28 |
| 3,735,705 | 5/1973 | Hudson, Jr. et al. | 102/28 |
| 3,753,403 | 8/1973 | Menichelli | 102/28 |
| 3,831,523 | 8/1974 | Thomas et al. | 102/28 |
| 3,882,324 | 5/1975 | Smolker et al. | 307/202 |
| 3,974,424 | 8/1976 | Lee | 317/80 |
| 4,061,088 | 12/1977 | Ueda | 102/28 |
| 4,271,453 | 6/1981 | Yajima et al. | 361/248 |
| 4,304,184 | 12/1981 | Jones | 102/202 |
| 4,378,738 | 4/1983 | Proctor et al. | 102/202 |
| 4,422,381 | 12/1983 | Barrett | 102/202 |
| 4,428,292 | 1/1984 | Riggs | 102/202 |
| 4,484,523 | 11/1984 | Smith et al. | 102/202.5 |
| 4,517,895 | 5/1985 | Rucker | 102/202 |
| 4,586,435 | 5/1986 | Bock | 102/202 |
| 4,592,280 | 6/1986 | Shores | 102/202 |
| 4,690,056 | 9/1987 | Brede et al. | 102/202 |
| 4,708,060 | 11/1987 | Bickes, Jr. et al. | 102/202 |
| 4,729,315 | 3/1988 | Proffit et al. | 102/202 |
| 4,779,532 | 10/1988 | Riley et al. | 102/202 |
| 4,819,560 | 4/1989 | Patz et al. | 102/202 |
| 4,840,122 | 6/1989 | Nerheim | 102/202 |
| 4,893,563 | 1/1990 | Baginski | 102/202 |
| 4,944,224 | 7/1990 | Fiedler et al. | 102/202 |

(List continued on next page.)

FOREIGN PATENT DOCUMENTS

| | | | |
|---|---|---|---|
| 581316 | 8/1959 | Canada . | |
| 0567959A2 | 11/1993 | European Pat. Off. . | |
| 3918408A1 | 12/1990 | Germany . | |
| WO9419661 | 9/1994 | WIPO | 102/202.5 |

OTHER PUBLICATIONS

The Semiconductor Junction Igniter: A Novel RF and EDS Insensitive Electro–Explosive Device, Thomas A Baginski, A Scottedward Hodel, IEEE Transactions on Industry Applications, vol. 29, No. 2, Mar./Apr. 1993.

Electrical Ignition Element, Uwe Brede, Translation of DE 3502526A1 Jan. 8, 1985.

*Primary Examiner*—Harold J. Tudor
*Attorney, Agent, or Firm*—Womble Carlyle Sandridge & Rice, PLLC

[57] ABSTRACT

An electro-explosive device is provided for detonating a pyrotechnic mix disposed adjacent the device to initiate an explosion. The device comprises a silicon wafer semiconductor substrate having a top surface and a bottom surface. The top surface of the substrate is covered with an insulating layer and a cavity is formed through the insulating layer a predetermined distance into the substrate. A first layer of conducting material covers the insulating layer and the interior walls of the cavity and a second layer of conducting material covers the bottom surface of the substrate. A primary explosive material is packed in the cavity. When the first and second layers of conducting material are coupled to a source of electric current, the current flows into the conducting material lining the walls of the cavity causing it to explode through ohmic heating in a plasma, thus igniting the primary explosive material within the cavity. The resulting energy is projected from the cavity in a shaped, relatively collimated pattern to detonate a pyrotechnic mix disposed adjacent the device.

26 Claims, 2 Drawing Sheets

U.S. PATENT DOCUMENTS

| | | | |
|---|---|---|---|
| 4,967,665 | 11/1990 | Baginski | 102/202 |
| 4,976,200 | 12/1990 | Benson et al. | 102/202 |
| 5,085,146 | 2/1992 | Baginski | 102/202 |
| 5,088,413 | 2/1992 | Huber et al. | 102/202 |
| 5,099,762 | 3/1992 | Drapala | 102/202 |
| 5,113,764 | 5/1992 | Mandigo et al. | 102/202.5 |
| 5,179,248 | 1/1993 | Hartman et al. | 102/202 |
| 5,285,727 | 2/1994 | Reams, Jr. et al. | 102/202.5 |
| 5,309,841 | 5/1994 | Hartman et al. | 102/202 |
| 5,327,834 | 7/1994 | Atkeson | 102/202.1 |
| 5,370,054 | 12/1994 | Reams et al. | 102/202.5 |
| 5,385,097 | 1/1995 | Hruska et al. | 102/202.5 |
| 5,448,114 | 9/1995 | Kondoh et al. | 257/778 |
| 5,454,320 | 10/1995 | Hilden et al. | 102/202 |
| 5,682,008 | 10/1997 | Chevinsky et al. | 102/202.7 |
| 5,847,309 | 12/1998 | Baginski | 102/202.5 |
| 5,912,427 | 6/1999 | Willis et al. | 102/202.7 |

ELECTRO-EXPLOSIVE DEVICE WITH SHAPED PRIMARY CHARGE

TECHNICAL FIELD

This invention relates generally to explosives and more specifically to electro-explosive devices for selective detonation of a primary charge in construction explosives, ordnance, and automotive air bags.

BACKGROUND OF THE INVENTION

An electro-explosive device (EED) is an apparatus for initiating the detonation of a primary explosive in a variety of explosive devices such as explosives used in the construction industry, military ordnance, and the inflation charges of automotive air bags. A blasting cap is one example of an EED. In general, an EED receives electrical energy and initiates a mechanical shock wave and/or an exothermic reaction, such as combustion or deflageration, that, in turn, is coupled to an adjacent primary explosive material or pyrotechnic mix to initiate explosion thereof. This explosion can then be coupled to a main charge for initiating explosion of the main charge. The EED has long been used both in commercial and military applications for a variety of purposes such as those mentioned above.

With reference to FIG. 1, a typical prior art EED 10 comprises a thin resistive wire or bridgewire 12 suspended between two posts 14, only one of which is shown. The bridgewire 12 is surrounded by a primary explosive compound or primary charge 18. To initiate combustion of the primary charge 18, a DC or very low frequency current is supplied through lead wires 16 and posts 14 and then through the bridgewire 12. The current passing through the bridgewire 12 results in ohmic heating of the bridgewire 12 and, when the bridgewire 12 reaches the ignition temperature of the primary charge 18, the charge ignites explosively. The explosion of the primary charge then ignites a secondary charge 20, which, in turn, ignites a main charge 22. The typical EED also includes various protective elements, such as a sleeve 23, a plug 24, and a case 26.

Although the EED 10 is a well known device, the electromagnetic environment in which EEDs must operate has changed dramatically over the past four decades. One such change, for example, has been that EEDs are subjected to higher levels of electromagnetic interference (EMI) due to the necessary proximity of EEDs to high power radar and communications equipment, such as on an aircraft carrier flight deck. The EED that initiates an automotive air bag charge may also be subjected to severe EMI during the normal life span of an automobile. Thus, EEDs are today subjected to high levels of EMI in both military and non-military environments.

The presence of intense EMI in the vicinity of EEDs causes a serious problem because the EMI can couple energy either through a direct or indirect path to an EED causing accidental firing. Energy may be coupled directly to an EED, for example, when RF radiation is incident on the EED's chassis wherein the EED acts as the load of a receiving antenna. Alternately, energy may be coupled indirectly to an EED when RF induced arcing occurs in the vicinity of the EED and is coupled to the EED, such as through its leads. Such an RF induced discharge can occur whenever a charge accumulated across an air gap is sufficient to ionize the gas in the gap and sustain an ionized channel.

Another manner in which an EED and its associated explosive may be accidentally discharged is by the coupling of a high voltage electrostatic discharge (ESD) to the EED.

Such a discharge, while usually insufficient to heat the bridgewire of the EED, nevertheless can create a sufficiently large electric field between the input pins of the EED to ignite the primary charge. EEDs can also be accidentally discharged by the inadvertent connection of its leads to a voltage supply such as an electrical outlet or the electrodes of an arc welder on a construction site. Such accidents have been known to occur in the past with obviously devastating results.

EEDs that are relatively insensitive to accidental detonation by EMI and ESD have been developed. In some cases, discrete electronic components, including resistors, capacitors, and inductors are connected to the EED to form various types of electrical filters that can block the effects of EMI and ESD. Such filters can usually be classified as L, Pi, or T filters and are well known by those of skill in the art. While these filters can be effective, they have the disadvantage of being relatively bulky, expensive, and requiring substantial space.

Much smaller and lighter EMI and ESD insensitive EEDs have been developed. One such device is disclosed in my pending U.S. patent application Ser. No. 08/518,169. In general, these devices have conductive bridges that are etched or deposited onto a silicon wafer substrate using standard integrated circuit construction techniques. Electronic components, such as diodes and resistive elements, are also formed on the substrate and are coupled to the bridge to form various filters, voltage dividers, shunts, and the like that function to isolate the bridge from the effects of EMI and ESD. The primary charge of explosive material is then packed with high pressure against the device and against the bridge. When a sufficiently high firing current is applied to the device, the material of the bridge explodes in a plasma, which expands outwardly from the substrate and condenses on the particles of the adjacent primary charge. This, in turn, couples energy in the form of heat to the primary charge to ignite it and, in turn, to ignite the explosive device in which the EED is installed.

While these printed circuit type EEDs have proven very successful at providing reliable detonation while being insensitive to accidental discharge by EMI and ESD, they nevertheless also have an inherent shortcoming. Specifically, since the bridge of the device is disposed on the flat surface of the silicon substrate, the plasma explosion of the bridge, when detonated, expands from the surface of the substrate and into the primary charge in a relatively broad and roughly hemispherical pattern. Accordingly, the energy of the exploding plasma dissipates relatively rapidly with distance from the substrate. This can result in the failure to couple sufficient energy to the primary charge to initiate ignition, particularly in instances when the material of the primary charge has migrated away from the bridge as a result of thermal expansion and contraction or mechanical shifting.

To address this problem, a larger volume of conductive material can be incorporated into the bridge to increase the overall energy of the plasma explosion of the bridge, but this carries the disadvantage of increasing the size and hence firing energy of the bridge, which is undesirable for a variety of reasons. Alternatively, a coating of a secondary material, such as zirconium, can be deposited on the bridge to increase the volume of plasma generated when the EED is detonated. While this is effective, it also requires additional manufacturing steps and costs and is still only a somewhat brute force solution to the problem.

Accordingly, there exists a need for an EED that is insensitive to accidental detonation by EMI, ESD, and accidental connection to common voltage sources, that reliably and consistently couples sufficient energy to a primary charge, that is unaffected by migration of the primary or secondary charge of the EED away from the point of plasma explosion, and that is small, lightweight, and economical to manufacture. It is to the provision of such an EED that the present invention is primarily directed.

SUMMARY OF THE INVENTION

Briefly described, the present invention, in one preferred embodiment thereof, comprises an electro-explosive device or detonator (EED) for initiating an explosion in a pyrotechnic mix. The device has applications in the fusing of high explosives used in the construction industry, in the firing of military and other ordnance, and in the initiation of the inflating charges of automotive air bags. In general, the EED of this invention is a solid state device that is formed on a silicon wafer semiconductor substrate by applying standard metal deposition, etching, and other techniques used in the fabrication of electronic integrated circuits.

In the preferred embodiment, the EED comprises a silicon wafer semiconductor substrate having a top surface and a bottom surface. The top and bottom surfaces of the wafer are first coated with a layer of insulating material. This can be accomplished by oxidizing the surface of the wafer to form a silicon dioxide layer. The silicon dioxide is then etched away or otherwise removed from the bottom surface of the substrate leaving an insulating layer of silicon dioxide only on the top surface. A cavity is then formed by a selective reactive ion etching or other processes through the layer of silicon dioxide on the top surface with the cavity extending a predetermined distance into the silicon substrate. A first layer of aluminum is then deposited on the silicon dioxide with the layer of aluminum covering the oxide and lining the interior walls of the cavity. A layer of aluminum is also deposited on the bottom surface of the silicon wafer substrate. Additional layers of conducting materials are then deposited on the aluminum layers to provide corrosion and oxidation resistance and to provide surfaces that are easily bondable to leads for coupling the layers to a source of electric current. In the preferred embodiment, the additional layers comprise a layer of titanium, a layer of nickel, and a layer of gold. In one embodiment, a primary explosive material is packed in the lined cavity formed through the top surface of the substrate.

In use, the EED of this invention is packaged in protective casing and a pyrotechnic mixture, such as PETN, is packed on top of the EED within the casing. The conductive layers are then coupled through leads that project from the casing or otherwise to a voltage source, such as a charged capacitor, capable of delivering a high level of current for a predetermined length of time. When sufficient voltage is applied, electric current flows into the conductive layers on the bottom surface of the substrate and through the silicon of the substrate. Since the top surface of the substrate is covered with an insulating layer of silicon dioxide with the exception of the walls of the cavity, all of the current passing into the relatively large area of conducting layers on the bottom of the substrate is constrained to flow through the walls of the cavity and into the relatively much smaller area of the metal layers that line the cavity.

The concentration of current in the small area of the cavity causes the lining of the cavity to be heated through ohmic heating to a high temperature very quickly. This, in turn, causes the metal lining of the cavity to explode toward the center of the cavity in a high speed, high temperature plasma. The exploding plasma couples sufficient energy to the primary explosive material packed in the cavity to ignite the material in an explosive exothermic reaction. The resulting energy of the plasma implosion and the exploding primary explosive is projected outwardly from the cavity in a shaped relatively narrow collimated pattern rather than a widely dispersed hemispherical pattern. This shaped charge then impinges on the pyrotechnic mix packed against the device and couples energy in the form of concentrated heat and shock to a small localized region of the mix. The heat and shock ignites the pyrotechnic mix, initiating an explosion that can be coupled to a main charge.

Thus, the EED of this invention produces a concentrated shaped primary charge that is much more efficient at igniting the adjacent pyrotechnic mix than dispersed charges. In addition, the device is inherently stable and insensitive to accidental discharge caused by EMI, ESD, and stray voltages that my inadvertently be coupled to its leads. Specifically, since there is no conducting bridge wire or bridge layer as with prior devices, currents that might otherwise be induced in these elements by EMI fields do not tend to materialize. Further, the junction between the aluminum layer and the silicon wafer substrate on the bottom surface of the substrate can form a Schottky barrier diode or pn junction. The composition and configuration of substrate and aluminum can be chosen to provide a predetermined and relatively high turn-on potential such as, for example, 500 volts. Thus, the device will only conduct current to the cavity lining and ignite when a voltage greater than the turn-on voltage is supplied. This provides very high stability even when the device is subjected to ESD events or is accidentally coupled to a high voltage source such as an arc welder or a 220 or 440 volt supply.

Accordingly, an EED is now provided that successfully addresses the problems and shortcomings of the prior art. The device produces a concentrated shaped primary charge that disperses slowly, effectively, and efficiently initiating explosion of an adjacent pyrotechnic mix. Since the primary explosive material is packed inside the cavity, the device is virtually immune to malfunction caused by migration of the explosive material. This is because the primary explosive material is imploded inwardly from all sides upon the plasma explosion of the metal lining of the cavity and because the resulting shaped charge does not disperse rapidly as it projects outwardly from the cavity. Further, the EED of this invention is inherently very stable and insensitive to accidental discharge caused by EMI and EDS events and by accidental connection to a common voltage supply. These and other features, objects, and advantages of the invention will become more apparent upon review of the detailed description set forth below taken in conjunction with the accompanying drawing figures, which are briefly described as follows.

DETAILED DESCRIPTION OF THE PREFERRED EMBODIMENTS

Figure 1:
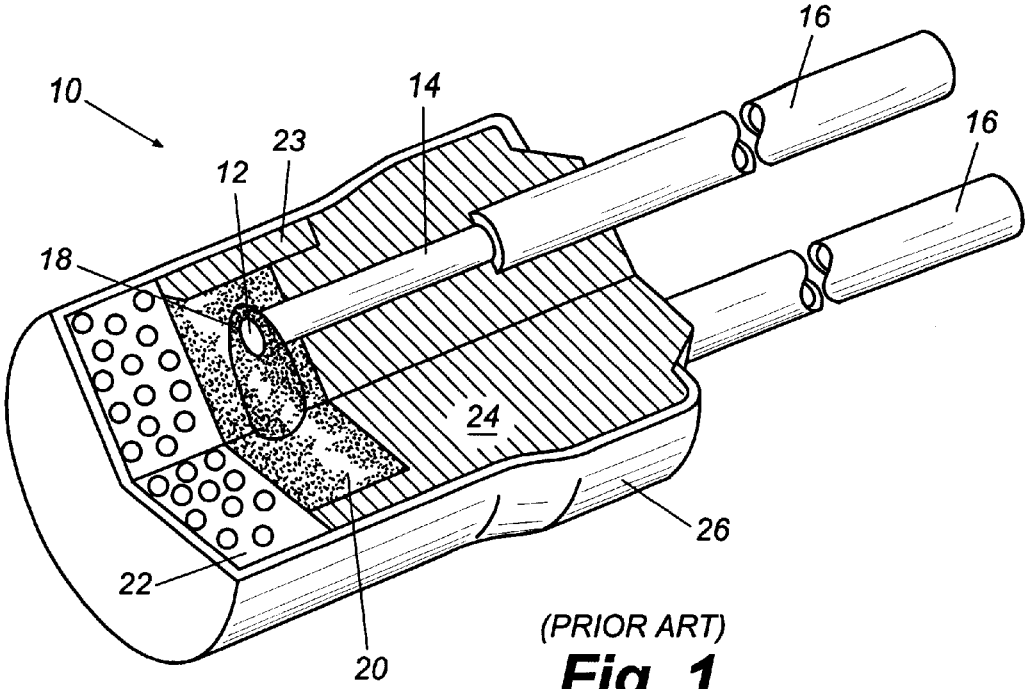
(PRIOR ART) Fig. 1
FIG. 1 is a perspective partially cut-away view of a typical prior art electro-explosive device incorporating a bridge wire initiator.

Referring now to the drawings, in which like numerals refer to like parts throughout the several views, FIG. 1 illustrates a typical prior art bridge wire-type EED. This device and its disadvantages have been discussed above and need not be repeated in detail here. In general, however, such devices are not suitable for use in modern environments because they are unpredictable and are subject to accidental discharge when exposed to EMI or ESD events.

Figure 2:
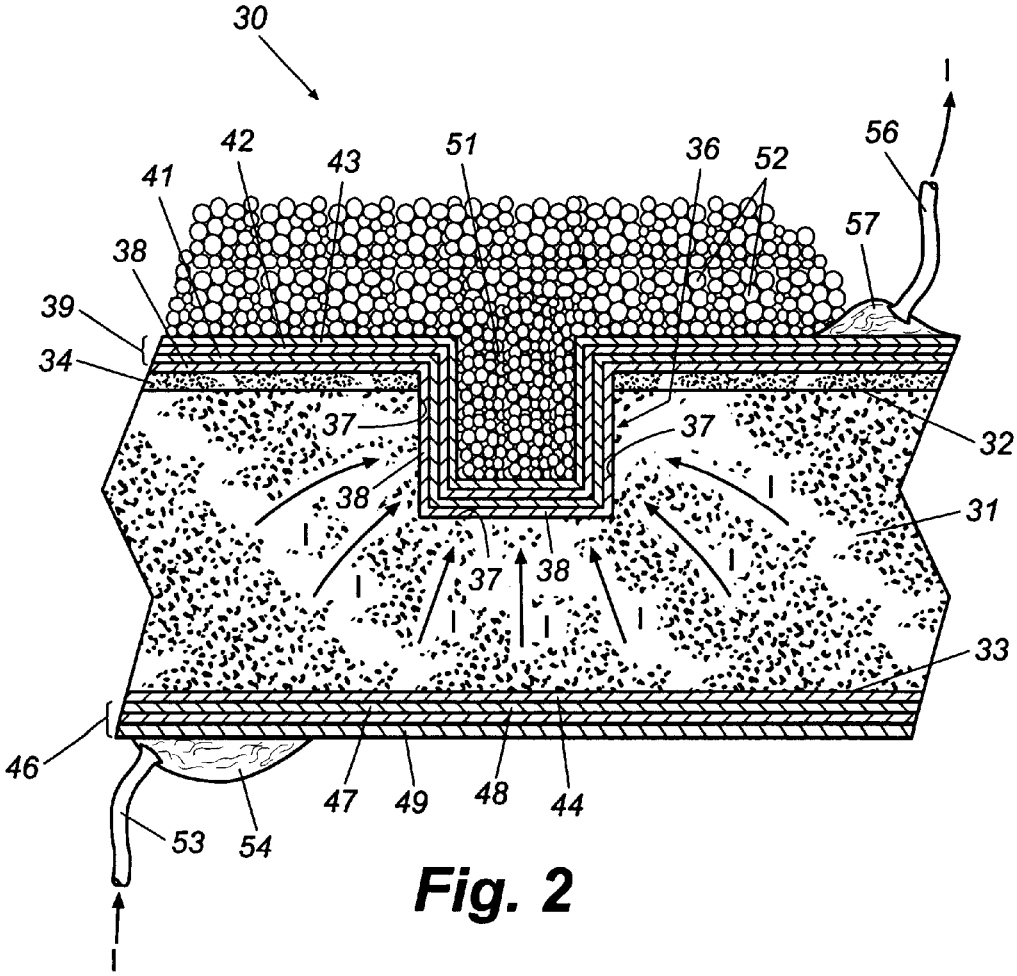
FIG. 2 is a cross-sectional view of an electro-explosive device that embodies principles of the present invention in one preferred form.

FIG. 2 is a cross-sectional view of a preferred embodiment of and EED constructed according to principles of the present invention. It will be understood that the view of FIG. 2 is taken through the cavity of the device to illustrate critical elements and features and that only a portion of the entire EED is shown. In use, the complete EED might take the form of a small disc or button with the cavity formed at its center or at some other location on its surface. The disc might then be installed in the bottom of a protective casing, similar to that illustrated in FIG. 1, and the casing packed with a secondary and/or main charge of explosive material. Alternately, the EED might take on a variety of final shapes and sizes in commercial use; however, the principle features of the invention applicable to all such final configurations are illustrated in FIG. 2. Finally, it should also be understood in reviewing the figures that the drawings are not to scale but that the relative sizes and element thicknesses shown in the drawings are selected for a clear understanding of the salient features and principles of the invention.

The EED 30 comprises a semiconductor substrate 31 that preferably takes the form of a doped silicon wafer of the type used in the fabrication of electronic integrated circuits. The substrate 31 has a top surface 32 and a bottom surface 33. A layer of insulating material, which is silicon dioxide in the preferred embodiment, but that can be other materials as well, is formed on the top surface of the substrate 31. The insulating layer can be formed on the surface of the substrate in a variety of ways, but a preferred method is to oxidize both sides of the silicon substrate and then to remove the oxide from the bottom surface 33 to leave the oxide layer 34 only on the top surface.

A cavity 36 is micromachined through the insulating oxide layer 38 and extends a predetermined distance into the silicon substrate material. The cavity 36 in the embodiment of FIG. 2 is generally cylindrical in shape, although other shapes are possible, and is defined by interior walls 37. The cavity preferably has a diameter of about 20 microns and extends into the substrate for a distance of about 20 microns. It is possible to fabricate such small cavities accurately in a silicon wafer substrate through a micromachining etching technique known by those of skill in the art as selective reactive ion etching.

A first layer 38 of conducting material is deposited on and covers the oxide layer 34 and also extends into and lines the interior walls 37 of the cavity 36. In the preferred embodiment, the first layer 38 is formed of aluminum, but can be formed of a variety of other conductive materials if desired. The layer 38 of aluminum can be deposited using a number of coating techniques known in the art such as, for example, vapor deposition and sputtering. Additional layers 39 of conductive material preferably are deposited over the aluminum layer to provide corrosion and oxidation resistance and to provide an exposed surface that can be bonded easily to power leads, as described in more detail below. In the preferred embodiment, the additional layers 39 comprise a layer 41 of titanium, a layer 42 of nickel, and an exposed layer 43 of gold. Other combinations of metals may also be used for the additional layers 39 such as, for example, titanium, nickel, palladium, and gold or titanium, palladium, and gold. These additional layers can also be deposited through known techniques such as vapor deposition. The additional layers 39 also extend into and line the cavity 36 in the illustrated embodiment, but this is not a requirement of the invention.

A second layer 44 of conductive material, aluminum in the preferred embodiment, is formed on the bottom surface of the silicon substrate. This second layer of aluminum can also be deposited through a number of techniques, but sputtering has been found to be preferable. The sputtering technique allows the aluminum sputtered onto the surface of the silicon to be infused with a small but saturating amount of silicon, about 1 percent. This is important to prevent silicon from the substrate from diffusing or dissolving into the aluminum at alloying temperatures. Such diffusion can degrade the interface that is formed at the junction of the aluminum and silicon, thereby degrading the characteristics of the resulting diode, which is discussed in more detail below.

As with the top surface 32, additional layers 46 of conducting material are deposited on the layer 44 of aluminum through appropriate deposition techniques. These additional layers preferably comprise a layer 47 of titanium, a layer 48 of nickel, and a layer 49 of gold but other metals and combinations of metals might be used. The additional layers 46 provide protection against corrosion and oxidation of the aluminum and also provide an exposed surface that is easily bonded to a lead for supplying current to the device.

In the preferred embodiment, the lined cavity 37 is packed with a primary charge of high explosive material 51. Suitable explosives for use as the primary charge include PETN, which has the advantage of becoming chemically inert above about 100 degrees Centigrade and is thus safe in the event that the EED is exposed to a fire. RDX is another high explosive material that is suitable for use as the primary explosive material 51. In any event, the material preferably takes the form of a powder having grains with a dimension about 1 order of magnitude less than the diameter of the cavity or, in this case, about 2 microns. A secondary explosive material or pyrotechnic mix 52 is packed atop the EED for detonation upon firing of the EED as described below. In use, the EED can be disposed in a protective casing and the pyrotechnic mix can be packed in the casing atop the EED.

A current input lead 53 is electrically coupled through a suitable bond 54 to the exposed metal on the bottom of the EED. The lead can be bonded to the metal through a variety of bonding techniques such as wire bonding, soldering, conductive epoxy, or any other suitable electrical bonding technique. Similarly, a current output lead 56 is electrically bonded to the exposed metal on the top of the EED. These two leads, in turn, may be connected to respective contacts or posts that project from a protective casing in which the EED is housed for application of a firing current to the device. The leads can also be coupled to the firing current through other physical structures and arrangements according to the needs and restraints of a particular application.

As mentioned above, the junction between the bottom surface 33 of the silicon substrate and the second layer 44 of aluminum forms a traditional Schottky barrier or pn junction and therefore defines a diode. The composition, configuration, and thickness of the substrate and aluminum can be determined through known calculations to provide a preselected turn-on voltage for the diode that is within a wide voltage range. For example, a turn-on voltage of 200 volts might be selected, in which case very little current would be conducted through the EED until the supply voltage applied to its leads exceeded 200 volts, in which event the diode would turn on allowing free flow of current.

This provides an important safety feature, as described in more detail below.

The EED of FIG. 2 functions to initiate an explosion as follows. The leads 53 and 56 are connected to a voltage source providing a potential higher than the turn-on voltage of the diode formed by the aluminum layer 44 and the silicon substrate 31 and capable of supplying a high current for at least a minimum length of time. In most instances, such a voltage source would comprise a charged capacitor, although other voltage sources could be used. When it is desired to fire the EED, the voltage source is coupled to the conducting layers on the top and bottom of the EED through, for example, a MOSFET transistor switch. The resulting voltage across the conducting layers causes the diode to turn on and conduct current I from the bottom conductive layers, through the silicon substrate, and toward the top conducting layers. However, because of the insulating layer of oxide on all of the top surface of the substrate with the exception of the walls of the cavity, the entire current I is constrained to pass through the metal lining of the cavity walls. Thus, the large current carried by the entire area of conducting layers on the bottom surface of the substrate is focused and concentrated through the relatively very small area of the conductive layers within the cavity. This causes the metal lining within the cavity to vaporize in a violent plasma explosion. Further, as the silicon in the vicinity of the cavity heats, it becomes resistive rather than semiconductive in nature, causing even more power to be coupled to the cavity lining.

The plasma that results from vaporization of the cavity lining travels at high velocity toward the center of the cavity from all sides. If there is no primary explosive material in the cavity, the imploding plasma is projected by the confining shape of the cavity out of the cavity in a shaped, concentrated, and relatively collimated pattern into the pyrotechnic mix 52 packed onto the device. Because of the shaped collimated nature of the projecting plasma, the energy of the plasma does not disperse rapidly with distance from the substrate and thus a relatively large amount of energy is coupled to the mix in a small confined area, heating the mix locally to its ignition temperature. Even if the pyrotechnic mix has migrated away from the EED through thermal expansion and contraction or mechanical shifting, the shaped column of plasma still couples a sufficient amount of energy to the mix. The coupling of energy to the pyrotechnic mix causes the mix to ignite and explode. Thus, it will be appreciated that the present invention may be used without a primary charge of explosive material 51 packed into the cavity and is still efficient and effective because of the shaped plasma explosion.

However, in the preferred embodiment, the cavity is packed with a primary charge of explosive material 51 as described above. In such an embodiment, the energy of the plasma explosion of the cavity lining is coupled directly to the primary charge from all sides. The primary charge is thus imploded and compressed and sufficient heat and/or shock is coupled to the primary charge to ignite it in an exothermic explosive reaction. The resulting energy of both the primary charge explosion and the plasma explosion is then projected out of the cavity in a shaped relatively collimated pattern that impinges on and ignites the pyrotechnic mix 52 as described above. The presence of the primary charge therefore substantially increases the energy coupled to the pyrotechnic mix. This, in turn, enhances the efficiency of the process allowing the cavity to be smaller while insuring reliable detonation of the pyrotechnic mix.

As mentioned above, the EED of the present invention is reliable and efficient when coupled to a firing voltage but is otherwise safe and insensitive to accidental firing by EMI and ESD events. Furthermore, since the firing current only flows when a voltage greater than the turn-on voltage of the diode is applied, application of voltages and potentials less than this turn-on voltage cause very little or no current to flow and do not fire the device. Accordingly, the device is also insensitive to accidental connection directly to an electrical service supply or an arc welder and is thus extremely safe.

Figure 3:
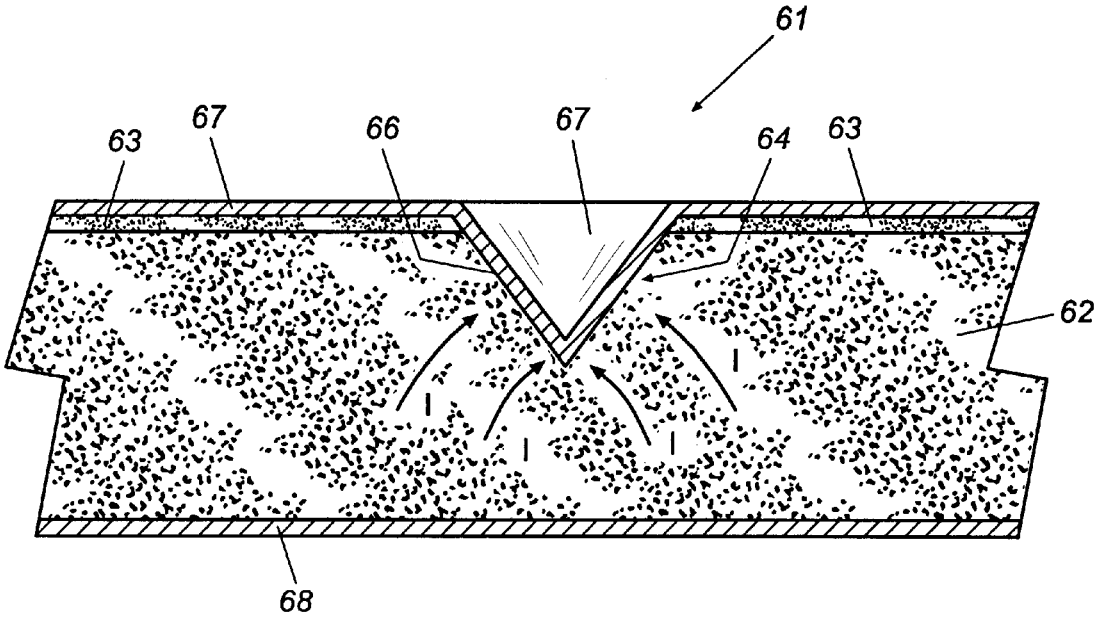
FIG. 3 is a cross-sectional view of an EED that embodies principles of the invention in an alternate form.

FIG. 3 illustrates an alternate embodiment of the EED of this invention designed to produce a shaped charge that can be focused to a relatively small point for ignition of, for example, a pellet of pyrotechnic material located at the point. As with the embodiment of FIG. 2, that of FIG. 3 comprises a semiconductor substrate 62 that preferably is a silicon wafer. The substrate has a top surface and a bottom surface and a layer of insulating oxide 63 is formed on and covers the top surface. A cavity 64, which, in this case, is conical in shape, is micromachined through the oxide layer 63 and extends a predetermined distance into the substrate. A first layer 67 of conducting material, which can consist of multiple layers of metal as shown in FIG. 2, is deposited on and covers the oxide layer 63 and the interior walls of the cavity. A second layer 68 of conducting material, which can also consist of multiple layers of metal, is deposited on and covers the bottom surface of the substrate and forms a diode therewith. This embodiment functions in the same general way as the embodiment of FIG. 2. However, because of the conical shape of the cavity, a plasma explosion resulting from a firing of the device is project from the cavity in a more focused shaped pattern. The energy of the plasma can thus be highly concentrated at the focal point of the pattern to ignite a pellet of pyrotechnic mix located at the focal point through the coupling of shock and/or thermal energy to the pellet. The process can also be enhanced, as in FIG. 2, by packing the cavity with a primary charge of high explosive material if desired.

Figure 4:
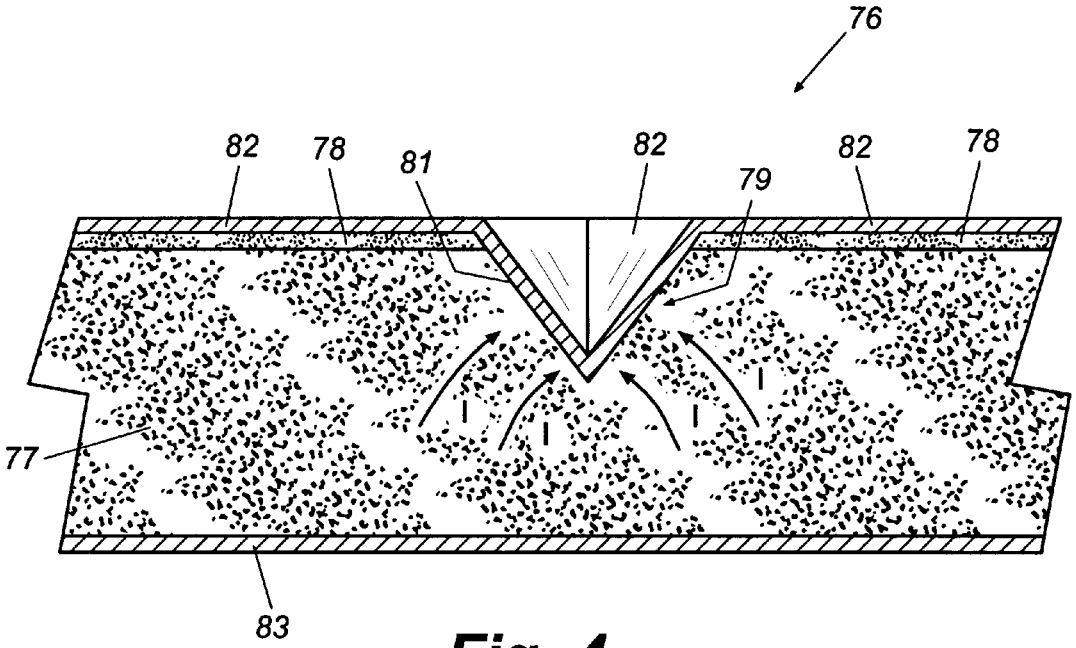
FIG. 4 is a cross-sectional view of an EED that embodies principles of the invention in yet another alternate form.

The embodiment of FIG. 4 is similar to that of FIG. 3 except that the cavity is micromachined so that its walls define a generally inverted pyramid shape. Here, the silicon substrate 77 is covered on its top surface with an insulating layer 78 of oxide and the cavity 79 in the shape of an inverted pyramid is machined through the oxide and into the substrate. A first layer 82 of conducting material covers the oxide layer and the interior walls 81 of the cavity and a second layer 83 of conducting material covers the bottom surface of the substrate. The function of this embodiment is substantially the same as that of FIG. 3 in that it produces a shaped focused charge upon firing that can efficiently ignite a pyrotechnic pellet located at the focus of the charge. Again, a primary charge of explosive material can be packed in the cavity if desired to enhance the effectiveness of the device. The embodiment of FIG. 3 is presented to illustrate that cavities having a variety of shapes might be micro-machined in the EED to accommodate a variety of desired detonation techniques.

The invention has been described herein in terms of preferred embodiments and methodologies for the purpose of illustrating the features and principles of the invention. The description is not intended to be exhaustive or to limit the invention to the precise forms disclosed. Many modifications and variations are possible in light of the above teaching without departing from the spirit and scope of the invention as set forth in the claims.

What is claimed is:

1. An electro-explosive device for initiating detonation of an adjacent pyrotechnic mixture, said electro-explosive device comprising:

a semiconductor substrate having a top surface and a bottom surface;

a layer of insulating material formed on said top surface of said substrate;

a cavity formed in said top surface of said substrate, said cavity extending through said layer of insulating material and extending a predetermined distance into said substrate, said cavity having interior walls;

a first layer of conducting material formed on and covering said layer of insulating material and said interior walls of said cavity; and a second layer of conducting material formed on and covering said bottom surface of said substrate;

said first and second layers of conducting material being electrically connectable to a source of current sufficient to flow through said second layer of conductive material, through said substrate, and through the portion of said first layer of conductive material covering said interior walls of said cavity to explode the conducting material within said cavity in a plasma to ignite a pyrotechnic mix disposed adjacent said device.

2. An electro-explosive device as claimed in claim 1 and wherein the junction between said second layer of conductive material and said semiconductor substrate forms a diode having a predetermined turn-on potential below which electric current will not flow through said second layer of conductive material, through said substrate, and into the conductive material covering said interior walls of said cavity.

3. An electro-explosive device as claimed in claim 2 and wherein said semiconductor substrate comprises silicon and said second layer of conductive material comprises aluminum.

4. An electro-explosive device as claimed in claim 3 and further comprising additional layers of conductive material formed on and covering said aluminum to provide corrosion protection and to provide an electrically bondable surface for coupling current to said aluminum.

5. An electro-explosive device as claimed in claim 4 and wherein said additional layers of conductive material comprise a layer of titanium, a layer of nickel, and a layer of gold.

6. An electro-explosive device as claimed in claim 3 and wherein said first layer of conductive material comprises aluminum.

7. An electro-explosive device as claimed in claim 6 and further comprising additional layers of conductive material formed on and covering said first layer of conductive material to provide corrosion protection and an electrically bondable surface.

8. An electro-explosive device as claimed in claim 7 and wherein said additional layers of conductive material covering said first layer of conductive material comprise a layer of titanium, a layer of nickel, and a layer of gold.

9. An electro-explosive device as claimed in claim 1 and further comprising a primary explosive material disposed in said cavity, said primary explosive material being ignited upon plasma explosion of said conductive material within said cavity to ignite a pyrotechnic mix adjacent said device.

10. An electro-explosive device as claimed in claim 9 and wherein said primary explosive material comprises PETN.

11. An electro-explosive device as claimed in claim 9 and wherein said primary explosive material comprises RDX.

12. An electro-explosive device as claimed in claim 9 and wherein said cavity has an interior dimension of about 20 microns and wherein said primary explosive material is a powder having grains of approximately 2 microns in size.

13. An electro-explosive device as claimed in claim 1 and wherein said cavity is generally cylindrical in shape.

14. An electro-explosive device as claimed in claim 1 and wherein said cavity tapers inwardly as it extends into said substrate.

15. An electro-explosive device as claimed in claim 14 and wherein said cavity has a generally conical shape.

16. An electro-explosive device as claimed in claim 14 and wherein said cavity is shaped generally as a pyramid.

17. An electro-explosive device as claimed in claim 1 and wherein said layer of insulating material comprises an oxide.

18. An electro-explosive device as claimed in claim 17 and wherein said oxide comprises silicon dioxide.

19. An electro-explosive detonator for igniting a pyrotechnic mix disposed adjacent said detonator, said detonator comprising;

a silicon semiconductor substrate having a top surface and a bottom surface;

an insulating layer of silicon dioxide formed on said top surface of said substrate;

a cavity formed through said layer of silicon dioxide and extending a predetermined distance into said silicon substrate, said cavity having interior walls;

a first layer of conducting material formed on and covering at least the interior walls of said cavity;

a second layer of conducting material formed on and covering at least a portion of said bottom surface of said silicon substrate; and means for coupling said first and second layers of conducting material to a source of electric current that flows through said second layer of conducting material, through said silicon substrate, and into said first layer of conducting material to implode the conducting material within said cavity in a plasma that is projected from the cavity with sufficient energy to ignite a pyrotechnic mix disposed adjacent said device.

20. An electro-explosive detonator as claimed in claim 19, and further comprising a primary explosive material disposed in said cavity for being ignited upon plasma explosion of said conductive material within said cavity to increase the energy projected from the cavity and enhance ignition of the pyrotechnic mix.

21. An electro-explosive detonator as claimed in claim 19 and wherein said first layer of conductive material also covers said layer of insulating material and wherein said second layer of conductive material covers said bottom surface of said silicon substrate.

22. An electro-explosive detonator as claimed in claim 21 and said first and second layers of conductive material comprise aluminum, said means for coupling electric current comprising additional layers of conductive material formed on said first and second layers of aluminum to provide an electrically bondable surface.

23. An electro-explosive detonator as claimed in claim 22 and wherein said additional layers of conductive material comprises a layer of titanium, a layer of nickel, and a layer of gold.

24. An electro-explosive device comprising a silicon semiconductor wafer substrate having a top surface and a bottom surface, a layer of silicon dioxide formed on and covering said top surface of said silicon wafer substrate, a cavity having interior walls and being formed through said layer of silicon dioxide extending a predetermined distance into said substrate, a first layer of aluminum formed on and covering said layer of silicon dioxide and said interior walls of said cavity, a second layer of aluminum formed on and covering said bottom surface of silicon wafer substrate, the junction between said second layer of aluminum and said silicon wafer substrate forming a diode having a predetermined turn-on voltage, additional layers of conducting material formed on and covering said first layer of aluminum to provide corrosion resistance and an electrically bondable surface, additional layers of conducting material formed on and covering said second layer of aluminum to provide corrosion resistance and an electrically bondable surface, and means for coupling said additional layers of conducting material on said first and second layers of aluminum to a source of electric current, the current flowing through said second layer of aluminum, through said silicon wafer substrate, and into said first layer of aluminum within said cavity to explode the aluminum within the cavity in a plasma for igniting a pyrotechnic mixture disposed adjacent said device.

25. An electro-explosive device as claimed in claim 24 and wherein said additional layers of conductive material on said first and second layers of aluminum comprise a layer of titanium, a layer of nickel, and a layer of gold.

26. An electro-explosive device as claimed in claim 25 and further comprising a primary explosive material disposed in said cavity for being ignited upon plasma explosion of said layers of conducting materials within said cavity to enhance ignition of a pyrotechnic mix disposed adjacent said device.

* * * * *